US006047690A

United States Patent [19]

Field et al.

[11] Patent Number: 6,047,690

[45] Date of Patent: Apr. 11, 2000

[54] EXHAUST GAS RECIRCULATION VALVE

[75] Inventors: Martin John Field, Leighton Buzzard, United Kingdom; Bernd Jakob Ballmert, Schifflange, Luxembourg; Laurence Alexander Collins, Athus, Belgium; Robert James Moran, Peterborough, United Kingdom; Andrew Vincent Degner, Rochester, N.Y.

[73] Assignee: General Motors Corporation, Detroit, Mich.

[21] Appl. No.: 09/148,883

[22] Filed: Sep. 4, 1998

[30] Foreign Application Priority Data

Sep. 4, 1997 [GB] United Kingdom ..... 9718680

[51] Int. Cl.[7] ..... F02M 25/07

[52] U.S. Cl. ..... 123/568.2; 123/568.26

[58] Field of Search ..... 123/568.11, 568.19, 123/568.2, 568.21, 568.22, 568.23, 568.25, 568.26, 568.27, 568.28, 569.29; 251/129.15, 129.16; 137/489.3, 625.25, 625.27, 625.28, 625.33

[56] References Cited

U.S. PATENT DOCUMENTS

| | | | |
|---|---|---|---|
| 3,799,131 | 3/1974 | Bolton | 123/568.29 |
| 4,024,847 | 5/1977 | Koganemaru | 123/568.2 |
| 4,142,491 | 3/1979 | Hibino et al. | 123/568.2 |
| 4,278,063 | 7/1981 | Nakamura et al. | 123/568.2 |
| 5,511,531 | 4/1996 | Cook et al. | 123/568.21 |
| 5,927,257 | 7/1999 | Hackett | 123/568.26 |

FOREIGN PATENT DOCUMENTS

| | | |
|---|---|---|
| 2174502 | 10/1973 | France . |
| 4338 192 | 5/1995 | Germany . |
| 19637078 | 3/1998 | Germany . |
| 1122842 | 8/1968 | United Kingdom . |

*Primary Examiner*—Willis R. Wolfe
*Attorney, Agent, or Firm*—Karl F Barr, Jr.

[57] ABSTRACT

An exhaust gas recirculation valve (10) for installation between an air intake (12) and an exhaust of an engine comprising a housing (18) having a first (20), second (22), and third (24) sides, a first bore (26) opening through the first side for connection with the air intake, a second bore (28) opening through the second side for receiving exhaust gas from the exhaust, a third bore (30) opening through the first side for connection with the air intake, and a fourth bore (32) opening through the third side and passing in succession through the first bore, the second bore and the third bore; a valve stem (34) positioned in the fourth bore and extending out of the third side of the housing; a valve seat (36) in the fourth bore at the opening (38) of the second bore to the third bore; an annular seal (40) mounted in the fourth bore at the opening (42) of the first bore to the second bore; a valve head (44) on the valve stem within the second bore and normally in engagement with the valve seat; a sleeve (46) mounted on the valve stem and sealingly engaged with the seal to substantially seal the first bore from the second bore; actuating means (50) mounted on the housing and connected to the valve stem, which, on actuation, moves the valve stem to disengage the valve head from the valve seat. EGR valve suitable for use with a diesel engine or an engine requiring large EGR rates.

10 Claims, 2 Drawing Sheets

EXHAUST GAS RECIRCULATION VALVE

TECHNICAL FIELD

The present invention relates to an exhaust gas recirculation valve (EGR valve) for a diesel engine or a gasoline direct injection (GDI) engine.

BACKGROUND OF THE INVENTION

Exhaust gas recirculation is used to allow a controlled amount of oxygen depleted exhaust gas to be mixed with inlet air flowing to an engine for combustion in the cylinders of the engine. EGR valves are used to reduce $NO_x$ emissions from engine exhaust gases. Electrically actuated EGR valves are now well known for current petrol/gasoline engines. However, these designs of EGR valve are generally unsuitable for diesel engines due to the substantially different requirements and operating conditions of a diesel engine when compared to a petrol/gasoline engine. Diesel engines using EGR valves are known, but these EGR valves are operated by large vacuum operated diaphragms which are generally too slow.

SUMMARY OF THE INVENTION

It is an object of the present invention to provide an EGR valve which is suitable for use with an engine which requires high EGR rates.

An exhaust gas recirculation valve in accordance with the present invention for installation between an air intake and an exhaust of an engine comprises a housing having a first, second, and third sides, a first bore opening through the first side for connection with the air intake, a second bore opening through the second side for receiving exhaust gas from the exhaust, a third bore opening through the first side for connection with the air intake, and a fourth bore opening through the third side and passing in succession through the first bore, the second bore and the third bore; a valve stem positioned in the fourth bore and extending out of the third side of the housing; a valve seat in the fourth bore at the opening of the second bore to the third bore; an annular seal mounted in the fourth bore at the opening of the first bore to the second bore; a valve head on the valve stem within the second bore and normally in engagement with the valve seat; a sleeve mounted on the valve stem and sealingly engaged with the seal to substantially seal the first bore from the second bore; actuating means mounted on the housing and connected to the valve stem, which, on actuation, moves the valve stem to disengage the valve head from the valve seat.

The present invention provides an EGR valve which is suitable for use with a diesel engine or an engine requiring high EGR rates, such as a GDI engine.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
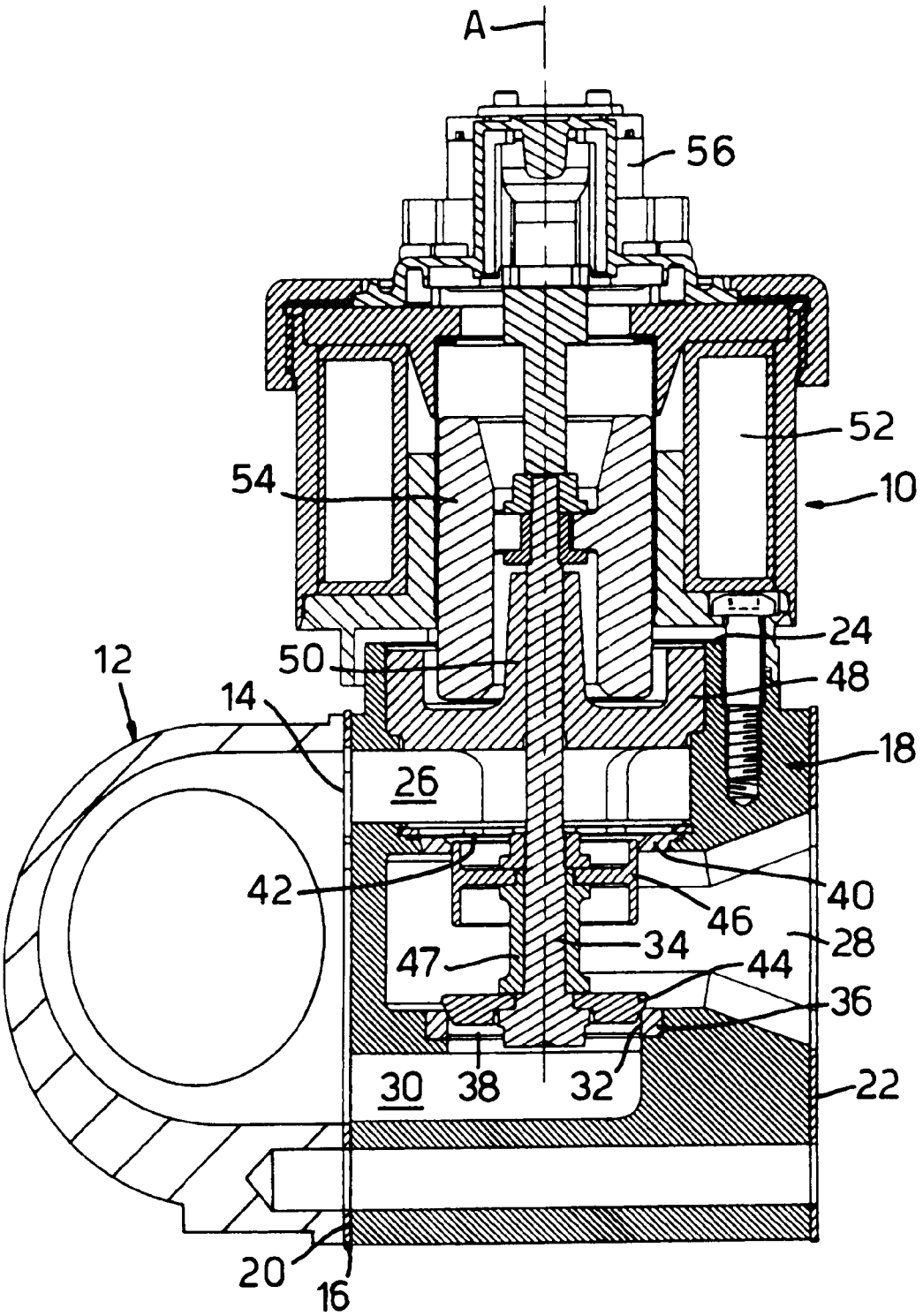
FIG. 1 is a cross-sectional view of a first embodiment of exhaust gas recirculation valve in accordance with the present invention.

Referring to FIG. 1, the first embodiment of exhaust gas recirculation (EGR) valve 10 in accordance with the present invention is shown when secured to an air intake manifold 12 of a diesel or other engine of a motor vehicle. The air intake manifold 12 has a side opening 14 across which the EGR valve 10 is secured in a substantially air-tight manner with a gasket 16 therebetween.

The EGR valve 10 includes a housing 18 having a first side 20 securable to the air intake manifold 12; a second side 22 on the opposed side of the housing to the first side, and a third side 24 extending between the first and second sides. The housing 18 has a first bore 26 which opens through the first side 20 into the side opening 14 in the air intake manifold 12; a second bore 28 which opens through the second side 22 and which is connected to the exhaust system (not shown) of the diesel engine to receive exhaust gas from the exhaust system; a third bore 30 which opens through the first side 20 into the side opening 14 in the air intake manifold; and a fourth bore 32 which opens through the third side 24. The fourth bore 32 passes in succession, from the third side 24, through the first bore 26, the second bore 28, and the third bore 30. The fourth bore 32 has a longitudinal axis A. The first, second and third bores 26,28,30 may be formed as slots in the housing 18.

A valve stem 34 is positioned in the fourth bore 32, has a longitudinal axis aligned with the axis A, and extends out of the housing 18 at the third side 24. A valve seat 36 is positioned in the fourth bore 32 at the opening 38 between the second bore 28 and the third bore 30. The valve seat 36 is either a separate insert as shown, or may be integrally formed in the housing 18. An annular seal 40 is positioned in the fourth bore 32 at the opening 42 between the first bore 26 and the second bore 28. A valve head 44 is mounted on the valve stem 34 on the second bore side of the opening 38, and normally engages the valve seat 36 to close the opening 38. As an alternative, the valve head may be integrally formed with the valve stem. A closed sleeve 46 is mounted on a tubular spacer 47 on the valve stem 34 and sealably engages the annular seal 40 to close the opening 42 between the first bore 26 and the second bore 28. The spacer 47 can ensure a predetermined axial separation between the sleeve 46 and the valve head 44. The mounting arrangement between the spacer 47 and the sleeve 46 is preferably such the sleeve 46 can rotate about, and move laterally by a limited amount, relative to the axis A to compensate for manufacturing tolerances to reduce the risk of sticking between the sleeve 46 and the annular seal 40. The fourth bore 32 is closed at the third bore 24 by an annular bushing 48. The annular bushing 48 has a tubular portion 50 through which the valve stem 34 extends, which provides a bearing support for the valve stem, and which substantially closes the first and fourth bores 26,32 from atmosphere.

An actuator in the form of an electromagnetic solenoid 52 is secured to the third side 24 of the housing 18. The solenoid 52 has an armature 54 which is secured to the valve stem 34. On actuation of the solenoid 52, the valve stem 34 pulls the valve head 44 away from the valve seat 36 to allow exhaust gas in the second bore 28 to pass through the opening 38 into the third bore 30 to mix with air in the air intake manifold 12. During actuation of the solenoid 52, the closed sleeve 46 remains in sealing contact with the annular seal 40. The operation of the solenoid 52 may be controlled by any suitable means, but is preferably operated dependent on signals from an engine control system which may calculate from suitable sensors (not shown) the required position of the valve stem 34. On de-actuation of the solenoid 52, the valve head 44 moves back into engagement with the valve seat 36 under the influence of exhaust gas pressure acting on the valve head, and gravity (where the solenoid 52 is positioned above the housing 18, as shown in FIG. 1). A spring (not shown) may also be positioned inside the solenoid 52, or a position sensor 56 associated with the solenoid, to act on the armature to bias the valve head 44 into engagement with the valve seat 36.

The present invention provides an EGR valve which is suitable for use with a diesel engine of a motor vehicle, especially diesel engines up to around 3000 cc. The arrangement of the annular seal 40, closed sleeve 46 and first bore 26 allows any exhaust gas which seeps past the valve stem 34 to enter the air intake manifold reducing the risk of seepage to atmosphere. This arrangement also reduces exhaust flow past the interface of the valve stem 34 with the tubular portion 50 thereby reducing the risk of carbon build up, corrosion damage, and sticking. Closing of the valve head 44 against the valve seat 36 under the influence of exhaust gas pressure provides a fail-safe arrangement for the EGR valve 10 in that the valve will be closed should the solenoid 52 fail.

The surface area of the closed sleeve 46 exposed to exhaust gas pressure in the second bore 28 is preferably slightly less than the surface area of the valve head 44 exposed to exhaust gas pressure in the second bore 28 to provide a substantially pressure balanced valve arrangement with a pressure closing bias. Such an arrangement helps to reduce the power needed by the solenoid 52 to move the valve head 44 away from the valve seat 36 against the pressure exerted on the valve head by the exhaust gas in the second bore 28. Modifications can be made to the above described embodiment. For example, other forms of actuator may be used besides an electromagnetic solenoid; and the first and second sides of the housing may be adjacent.

Figure 2:
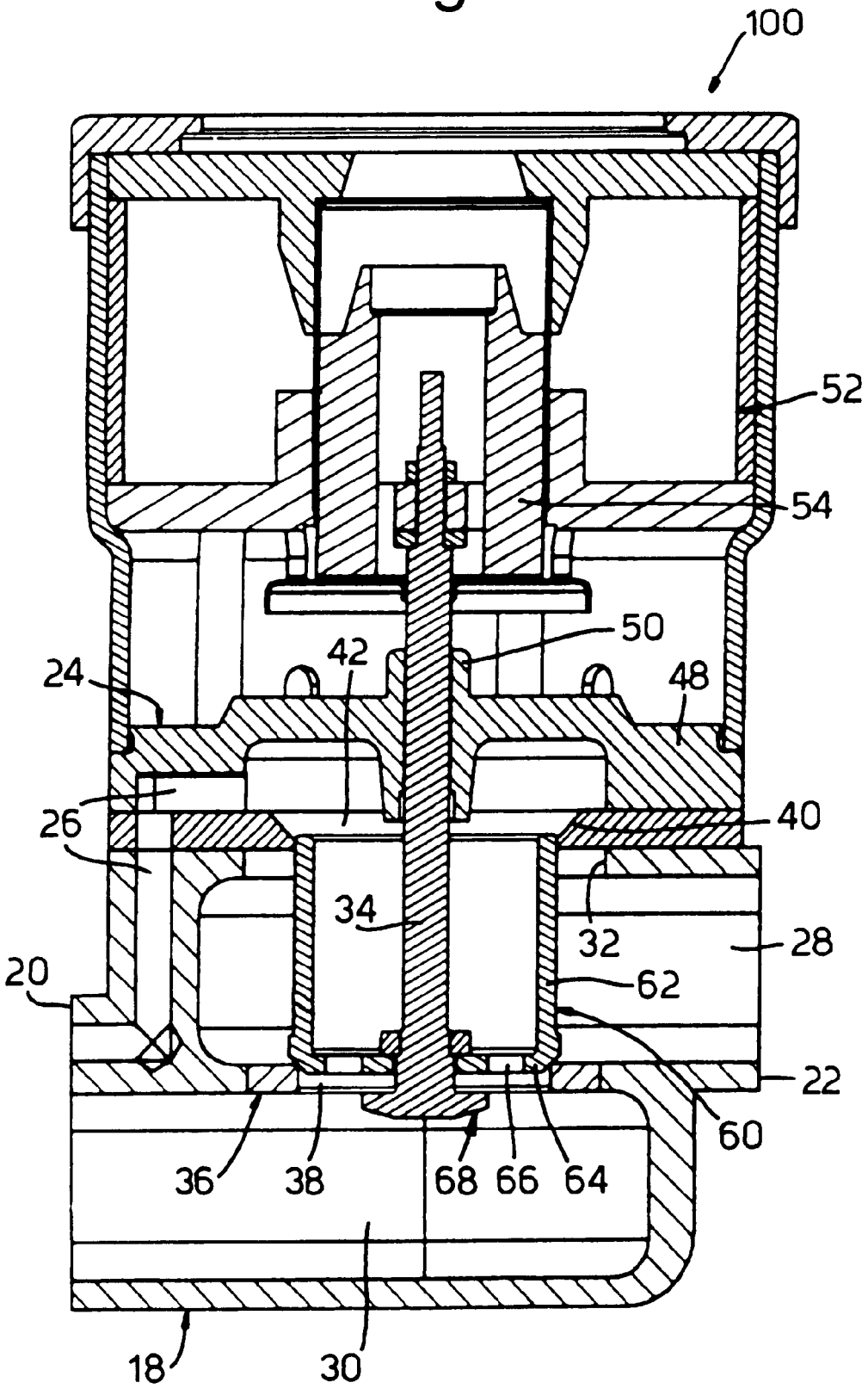
FIG. 2 is a cross-sectional view of a second embodiment of exhaust gas recirculation valve in accordance with the present invention.

In the second embodiment of EGR valve 100 shown in FIG. 2, like parts have been given the same reference numeral as in FIG. 1. In this second embodiment, when compared to the first embodiment, the valve head and the closed sleeve have been replaced by a single component, a bucket valve 60. The bucket valve 60 has a cross-section which is substantially U-shaped with an outer wall 62 which makes a sealing sliding fit with the annular seal 40, and a base wall 64 which defines a valve head engaging the valve seat 36. The bucket valve 60 is preferably capable of rotating about, and moving laterally by a small amount, relative to the valve stem 34 to reduce the risk of sticking between the outer wall 62 and the seal 40. The base wall 64 may include apertures 66 which allow air to circulate through the EGR valve 100 from the first bore 26 to the third bore 30 when the valve is closed. The apertures 66 also assure that the pressure in the first bore 26 is the same as that acting on the base wall 64 for all positions of the bucket valve 60. As a further modification, the valve stem 34 has an enlarged head 68 at its end remote from the solenoid 52, and the bucket valve 60 is mounted on the valve stem in such a way as to allow small amount of relative movement between the bucket valve and the valve stem along axis A. With this latter arrangement, on actuation of the solenoid 52, the valve stem 34 initially moves relative to the bucket valve 60 until the head 68 strikes the base wall 64, and then both the valve stem and the bucket valve move together to open the second bore 28 to the third bore 30. The engagement of the head 68 on the base wall 64 assists in the disengagement of the bucket valve 60 from the valve seat 36 against the pressure of the exhaust gas, and assists in the disengagement should the bucket valve 60 stick to the valve seat 36. Still further, the bushing 48 is integrally mounted on the housing 18 to define the third side 24 of the housing and is shaped internally to define a portion of the first bore 26 of the EGR valve 100.

We claim:

1. An exhaust gas recirculation valve for installation between an air intake and an exhaust of an engine comprising a housing having a first, second, and third sides, a first bore opening through the first side for connection with the air intake, a second bore opening through the second side for receiving exhaust gas from the exhaust, a third bore opening through the first side for connection with the air intake, and a fourth bore opening through the third side and passing in succession through the first bore, the second bore and the third bore; a valve stem positioned in the fourth bore and extending out of the third side of the housing; a valve seat in the fourth bore at the opening of the second bore to the third bore; an annular seal mounted in the fourth bore at the opening of the first bore to the second bore; a valve head on the valve stem within the second bore and normally in engagement with the valve seat; a sleeve mounted on the valve stem and sealingly engaged with the seal to substantially seal the first bore from the second bore; actuating means mounted on the housing and connected to the valve stem, which, on actuation, moves the valve stem to disengage the valve head from the valve seat.

2. An exhaust gas recirculation valve as claimed in claim 1, wherein the first side is on the opposed side of the housing to the second side.

3. An exhaust gas recirculation valve as claimed in claim 1, wherein the actuating means is mounted on the third side of the housing.

4. An exhaust gas recirculation valve as claimed in claim 1, wherein the actuating means is an electromagnetic solenoid.

5. An exhaust gas recirculation valve as claimed in claim 1, wherein the surface area of the sleeve exposed to the second bore is substantially the same as, or slightly less than, the surface area of the valve head exposed to the second bore.

6. An exhaust gas recirculation valve as claimed in claim 1, wherein the valve stem extends through a tubular portion of a bushing mounted on the third side of the housing.

7. An exhaust gas recirculation valve as claimed in claim 6, wherein the bushing defines the third side of the housing, and defines internally a portion of the first bore.

8. An exhaust gas recirculation valve as claimed in claim 1, wherein the valve head and the sleeve are integrally formed as a bucket valve having a substantially U-shaped cross-section with a base wall defining the valve head and an outer wall defining the sleeve.

9. An exhaust gas recirculation valve as claimed in claim 8, wherein the base wall has apertures therein to provide a flow path from the first bore to the third bore when the valve head is in engagement with the valve seat.

10. An exhaust gas recirculation valve as claimed in claim 1, wherein the sleeve is capable of rotating about, and moving laterally by a small amount, relative to the valve stem.

* * * * *